US005248005A

United States Patent [19]

Mochizuki

[11] Patent Number: 5,248,005

[45] Date of Patent: Sep. 28, 1993

[54] SELF-PROPELLED DRILLING MODULE

[75] Inventor: David A. Mochizuki, Anchorage, Ak.

[73] Assignee: Nabors Industries, Inc., Houston, Tex.

[21] Appl. No.: 655,562

[22] Filed: Feb. 13, 1991

[51] Int. Cl.[5] ..... E21B 7/02; E21B 36/00

[52] U.S. Cl. ..... 175/85; 166/901; 175/219

[58] Field of Search ..... 175/52, 85, 219, 162, 175/202, 203; 166/901

[56] References Cited

U.S. PATENT DOCUMENTS

| | | | |
|---|---|---|---|
| 2,872,933 | 2/1959 | Mackey | 135/1 |
| 3,145,786 | 8/1964 | O'Neill et al. | 175/85 |
| 3,719,238 | 3/1973 | Campbell et al. | 173/147 |
| 3,734,210 | 5/1973 | Wilderman | 175/85 |
| 3,734,211 | 5/1973 | Haisch et al. | 175/85 |
| 3,744,259 | 7/1973 | Wagley | 61/72.5 |
| 3,865,197 | 2/1975 | McCormick | 175/219 X |
| 3,946,571 | 3/1976 | Pate et al. | 61/69 R |
| 4,823,870 | 4/1989 | Sorokan | 166/79 |

FOREIGN PATENT DOCUMENTS

| | | | |
|---|---|---|---|
| 118357 | 3/1958 | U.S.S.R. | 840/102 |
| 641058 | 1/1979 | U.S.S.R. . | |
| 703643 | 12/1979 | U.S.S.R. . | |

*Primary Examiner*—William P. Neuder
*Attorney, Agent, or Firm*—Fish & Richardson

[57] ABSTRACT

There is provided a portable drilling module that is preferably mounted onto a self-propelled carrier. Winterizing panels enclose equipment mounted aboard the module and provide an environmentally sheltered space for workmen. In particular, the panels fully surround a rear portion of the module that is adapted to be positioned over a well, and allow a full load of pipe to be temporarily stored within this portion of the module. Moreover, a number of the panels may be removed to reduce the weight of the module so that it can be transported and used for workover operations in warmer months.

22 Claims, 7 Drawing Sheets

SELF-PROPELLED DRILLING MODULE

INFORMATION REGARDING RELATED APPLICATIONS

The invention described herein is related to the inventions described in the following applications, all of which are filed concurrently herewith and subject to assignment to the same assignee:

Fully Articulated Ramp Extension For Pipe Handling Apparatus, U.S. Pat. No. 5,122,023; Method and Apparatus for Controlling the Transfer of Tubular Members Into a Shelter, U.S. Pat. No. 5,072,656; Mobile Drilling Rig for closely Spaced Well Centers, U.S. Pat. No. 5,109,934; and Harness method and Apparatus, U.S. Pat. No. 5,125,857.

BACKGROUND OF THE INVENTION

1. Field of the Invention

The present invention relates generally to drilling rigs and, more particularly, to a self-propelled well servicing and workover rig for use in harsh arctic environments.

2. Description Of The Related Art

When working in harsh arctic environments, even the simplest tasks which must be performed outside often become quite difficult. For instance, during the winter months in Alaska on the North Slope, ambient temperatures often fall below −50° F. Since oil exploration and production continues throughout the winter in these areas, workmen working outside are subjected to the snow, wind and bitter cold. As a result, the productivity and morale of the workmen suffer in these less than ideal working conditions.

To mitigate these problems heated shelters are provided where possible. Typically, these shelters must surround cumbersome machinery and still provide enough space for the workmen to operate and maintain the machinery. Although providing shelter at a fixed work site can be accomplished by building a semi-permanent structure, providing shelter on temporary work sites poses greater problems. For instance, wells may require workovers when production of the oil slows or ceases. Workovers may include through-tubing clean outs, stimulations, and fishing jobs.

Workovers can be accomplished by erecting a free-standing derrick over the well, performing the workover, and then disassembling the derrick. However, workovers typically require much less time to complete than the initial drilling operation. Therefore, assembling and disassembling a derrick to perform a workover introduces an inefficiency that may significantly offset the benefits of the workover. To overcome this inefficiency, portable drilling rigs, commonly called "workover rigs," typically perform workovers. These portable drilling rigs include a derrick that is mounted on a trailer or self-propelled chassis. The derrick may be pivoted from a portable position, where the derrick rests horizontally on the rig, to a working position, where the derrick is fixed in a substantially upright position over the well.

Workovers require much equipment in addition to the portable derrick. Many downhole operations are accomplished using a pipe string that is introduced into the well from the derrick. The pipe string is made up of a series of short interconnected pipe sections. In a drilling operation, for instance, a bit is placed on the lower end of the pipe string, and the pipe string is rotated from above the earth's surface by a suitable rotary drive mechanism. As the bit bores deeper, additional pipe sections must be connected to the pipe string. Moreover, in order to satisfactorily form the bore, the cuttings produced as the bit bores deeper must be carried out of the well hole. For this purpose, a mud slurry is pumped downwardly through the pipe to gather the cuttings, and then pumped upwardly around the annulus between the pipe and the well hole to remove the cuttings. Therefore, a supply of tools, pipe, and mud should be readily available to the drillers performing the workover.

Supplying tools, pipe, and mud to a portable drilling rig in warm climates presents relatively few problems. The pipe is simply arranged in racks adjacent the derrick. As more pipe is needed, operators load pipe onto a suitable conveyor and guide the pipe toward the derrick along a ramp, typically referred to as a beaver slide, for delivery to the derrick. Similarly, equipment for mixing a suitable slurry of mud may be positioned outside on the ground adjacent the derrick. Then, it is a relatively simple procedure for operators to arrange pumps and piping for pumping mud into the well through the drill string and out of the well through the well annulus. Moreover, when changing a drill bit, or withdrawing pipe from the well for any other reason, the detached sections of pipe may be simply removed from the derrick and placed in a convenient location on racks on the ground.

However, portable drilling rigs of this type present distinct disadvantages when used in a cold environment. For example, the rigs offer no shelter to the workmen. Furthermore, the pipe may become damaged or difficult to manage because it is not protected from the environment. In frigid environments, ice may form on the threads of pipe stored outside and, thus, cause the threads to deform during connection unless the ice is removed. To overcome these problems, winterized portable drilling rigs have been developed. On these winterized rigs, portions of the chassis carrying equipment for use by the workmen are enclosed in a housing which may be thought of as a vehicle body.

In addition to the winterizing of the portable derricks themselves, pipe shelters and mud/utility support modules have been developed. A pipe shelter essentially includes a trailer having a number of pipe racks for carrying the pipe to be used on the derrick, and a pipe conveyor for transferring pipe up the beaver slide to the derrick. These apparatus are enclosed by a winterized housing which has a door therein for receiving additional loads of pipe. In cold climates, it is important to keep the pipe warm so that new sections of pipe easily interconnect with pipe in the pipe string.

In a similar fashion, the mud module includes the necessary mud producing equipment, such as water and mud tanks, which is mounted on a trailer chassis. A winterized housing encloses the equipment on the trailer chassis, and usually includes a passageway for interconnecting the mud module to the portable drilling module. Thus, once the mud module and the pipe shelter are interconnected with the portable drilling module, the winterized drilling rig protects the workmen and the necessary support equipment from the environment.

Unfortunately, these winterized rigs still exhibit certain disadvantages. For example, at −50°F., it is important that the winterized shelters of the various modules of the portable drilling rig protect the workmen in as many phases of normal operation as possible. As one example, a pipe shelter includes a door for loading and unloading pipe. If this door remains open too long, the heat within the shelter will rapidly escape, thus leaving the workmen inside exposed to frigid temperatures.

As another example, it is advantageous if the workmen can retrieve pipe from the well bore quickly and efficiently. As sections of pipe are detached from the drill string, the pipe must be stored, at least temporarily. Therefore, many times workmen will open a door in the derrick housing and place detached sections of pipe on the ground outside of the derrick. Of course, every time the derrick is opened, heat escapes and the workmen are exposed to the cold environment. Additionally, workmen are exposed when they leave the derrick to collect the pipe. Alternatively, detached sections of pipe may be sent down the beaver slide into the pipe shelter. While this alleviates the problem of exposing workers to the cold environment, it is a slow and inefficient way of temporarily storing pipe.

In addition to not properly sheltering the workmen during all phases of an operation, many winterized rigs cannot be used as the weather warms. In the winter in Alaska, the ground remains frozen, and the heavy winterized rigs travel easily from one work site to another. However, in the summer months, the ground softens. In some instances, the rigs face the danger of becoming stuck if the ground becomes too soft. In any event, in the summer months the rigs tend to damage roadways and, therefore, become undesirable.

Moreover, self-propelled rigs are much preferred as compared to trailer-mounted rigs. Trailer-mounted rigs must be hauled from one worksite to another by large tractors. Not surprisingly, these tractors are quite expensive to operate, lease and own. In addition, self-propelled rigs can be easily configured for transportation so that they are easier to move than trailer-mounted rigs.

The present invention is directed to overcoming, or at least minimizing, one or more of the problems as set forth above.

SUMMARY OF THE INVENTION

In accordance with one aspect of the present invention, there is provided a drilling apparatus which includes a wheeled carrier having a derrick disposed thereon. The derrick is adapted to be positioned over a well and to control insertion and retraction of at least 8000 feet of pipe sections. A shelter is also disposed on the carrier. The shelter is adapted to extend from the well to a preselected height on the derrick and thereby substantially surround a portion of the derrick.

In accordance with another aspect of the present invention, there is provided a drilling apparatus which includes a wheeled carrier having a drill floor coupled thereto or integral therewith. A derrick is also disposed on the carrier and adapted to be positioned over a well adjacent the drill floor. A shelter is disposed on the carrier and substantially encloses the carrier and the drill floor. Furthermore, a plurality of hydraulically operated feet are disposed on the carrier. The feet are extendable into contact with the ground for working and retractable for transportation. A selected portion of the feet are located beneath the drill floor and are encompassed by the shelter in both the extended and retracted positions.

BRIEF DESCRIPTION OF THE DRAWINGS

The foregoing and other advantages of the invention will become apparent upon reading the following detailed description and upon reference to the drawings in which.

Figure 1:
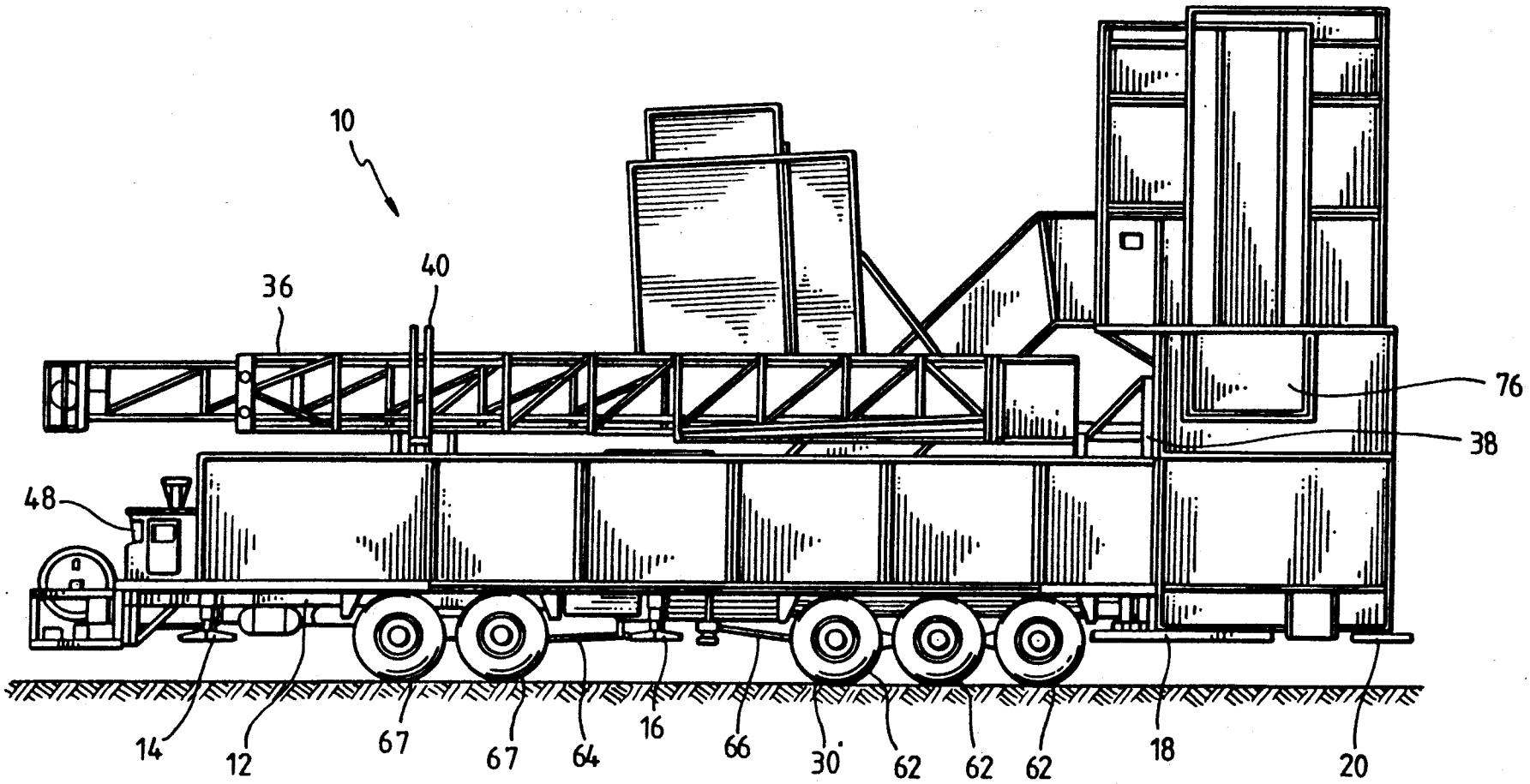
FIG. 1 illustrates a side view of a portable drilling module in a transportation mode in accordance with the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives following within the spirit and scope of the invention as defined by the appended claims.

DESCRIPTION OF THE PREFERRED EMBODIMENTS

Figure 2:
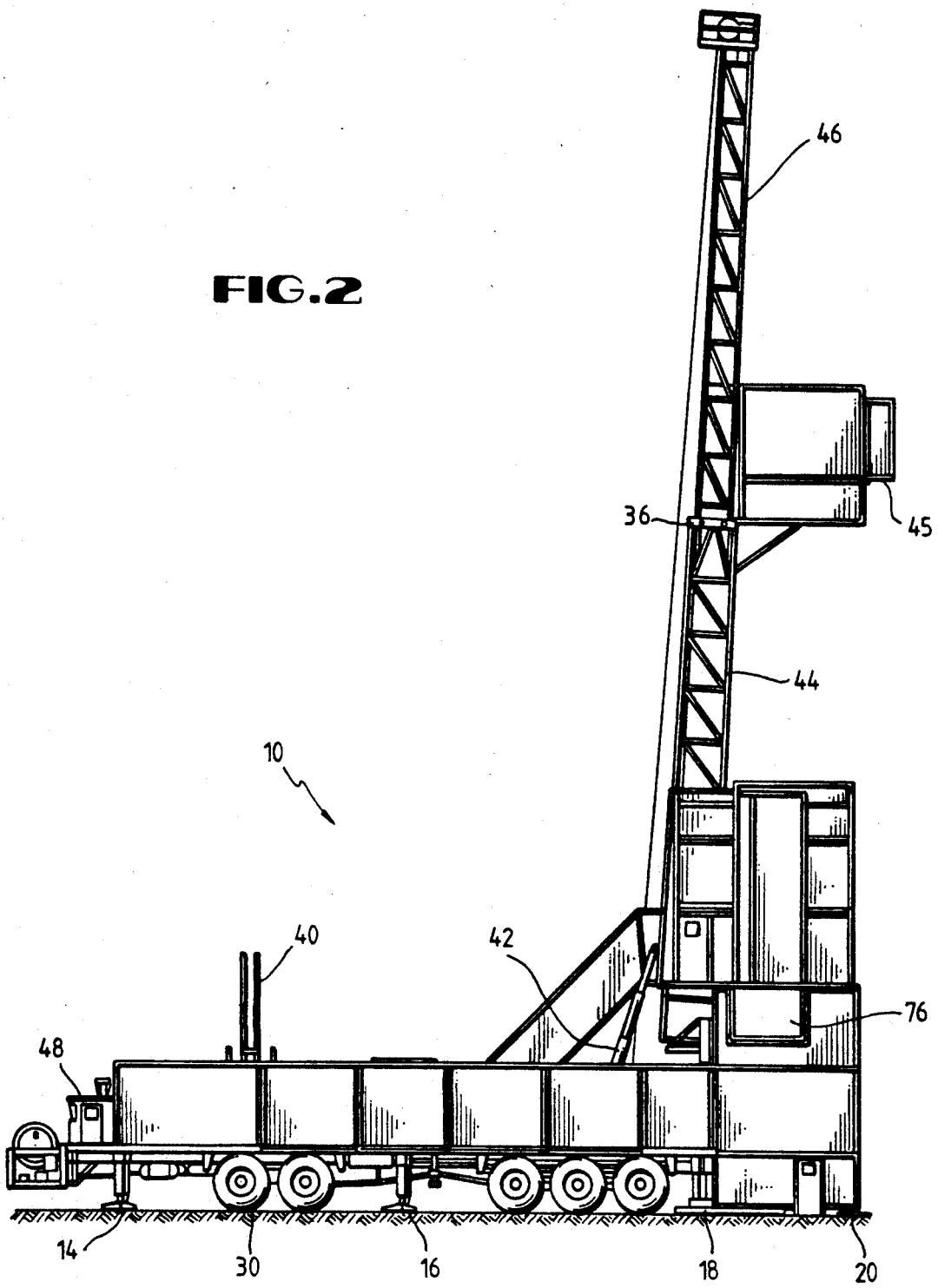
FIG. 2 illustrates the portable drilling module in a working mode in accordance with the present invention.

Turning now to the drawings and referring initially to FIGS. 1 and 2, a self-propelled drilling module is illustrated and generally designated by the reference numeral 10. Generally speaking, the drilling module 10 operates in two different modes: a transportation mode and a working mode. FIG. 1 illustrates the module 10 in its transportation mode, and FIG. 2 illustrates the module 10 in its working mode. The module 10 is mounted on a carrier 12 so that it can be transported from one worksite to another with a minimum of tear-down and reconstruction. To position the drilling module 10 once it reaches a worksite, the operator reverses the carrier 12 and backs over the well. Preferably, operators use a crosshair (not shown) mounted at the rear of the carrier 12 to accurately position the module 10 over the center of the well.

Figure 3:
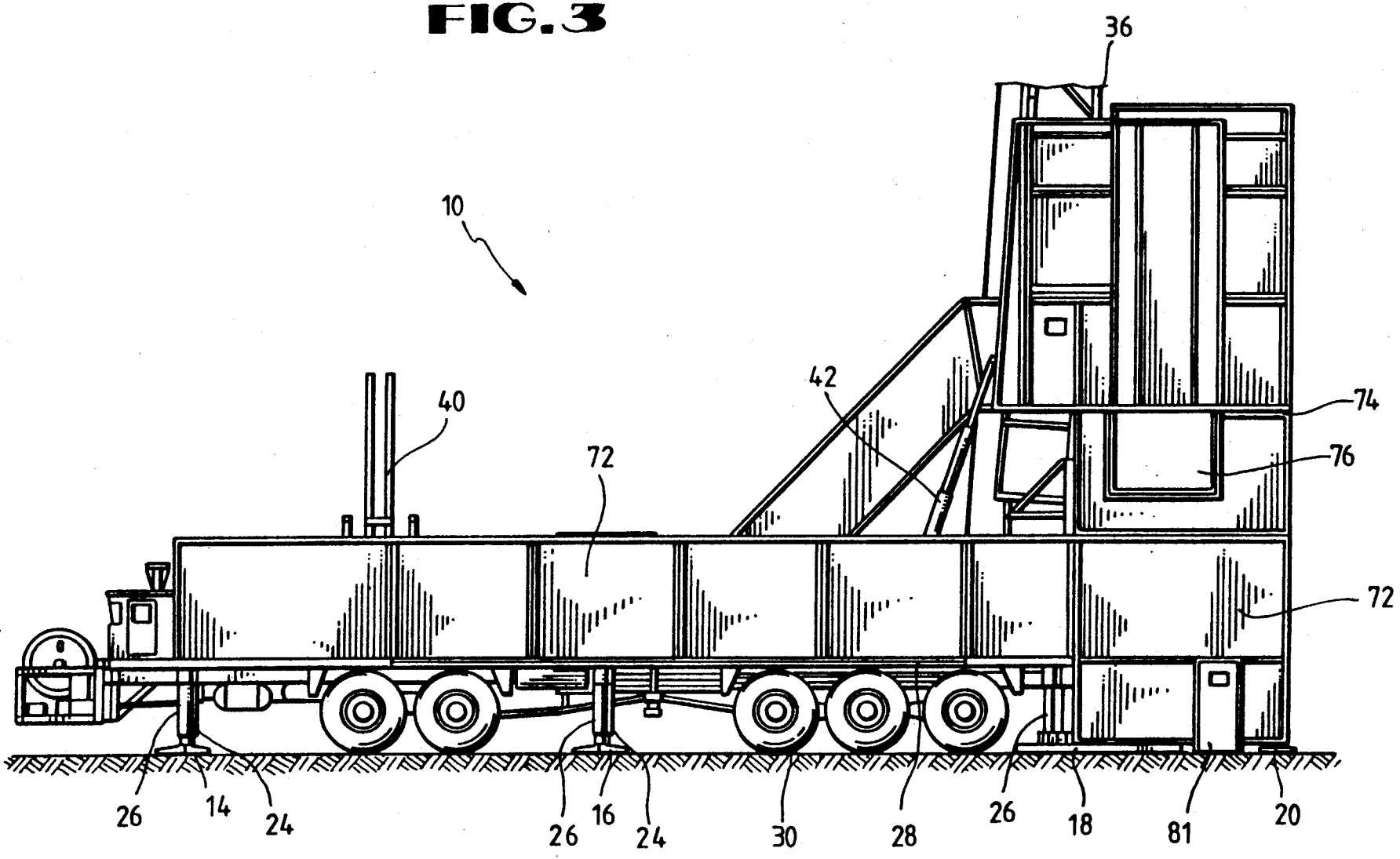
FIG. 3 illustrates a detailed side view of the lower portion of the portable drilling module in a working mode in accordance with the present invention.

Once the module 10 has been properly positioned with respect to the well, the operators convert the module 10 from its transportation mode into its working mode. First, to provide a stable platform for the workover procedures, a number of hydraulically actuated feet 14, 16, 18, 20 and 22 are lowered to the ground (see also FIG. 4). As can be seen best with respect to the feet 14 and 16 in FIG. 3, a respective hydraulic cylinder 24 lowers each foot 14, 16, 18, 20 and 22 to the ground. Each foot 14, 16, 18, 20 and 22 is guided to the ground by a respective guide post 26 positioned adjacent each hydraulic cylinder 24. The hydraulically operated feet 14, 16, 18, 20 and 22 raise the floor 28 of the carrier 12 to its working height, which is preferably about 6′ 8″ from the ground. Once the hydraulic cylinders 24 have raised the carrier 12 to its working height, a locking screw (not shown) associated with each guide post 26 fixes the length of each guide post 26. After the guide posts 26 have been locked, the hydraulic cylinders 24 may be de-energized so that the guide posts 26 support the weight of the module 10. Preferably, in its working mode, the tires 30 of the carrier 12 support none of the weight of the module 10. Rather, the entire weight of the module 10 is supported by the guide posts 26 and the feet 14, 16, 18, 20 and 22.

Figure 4:
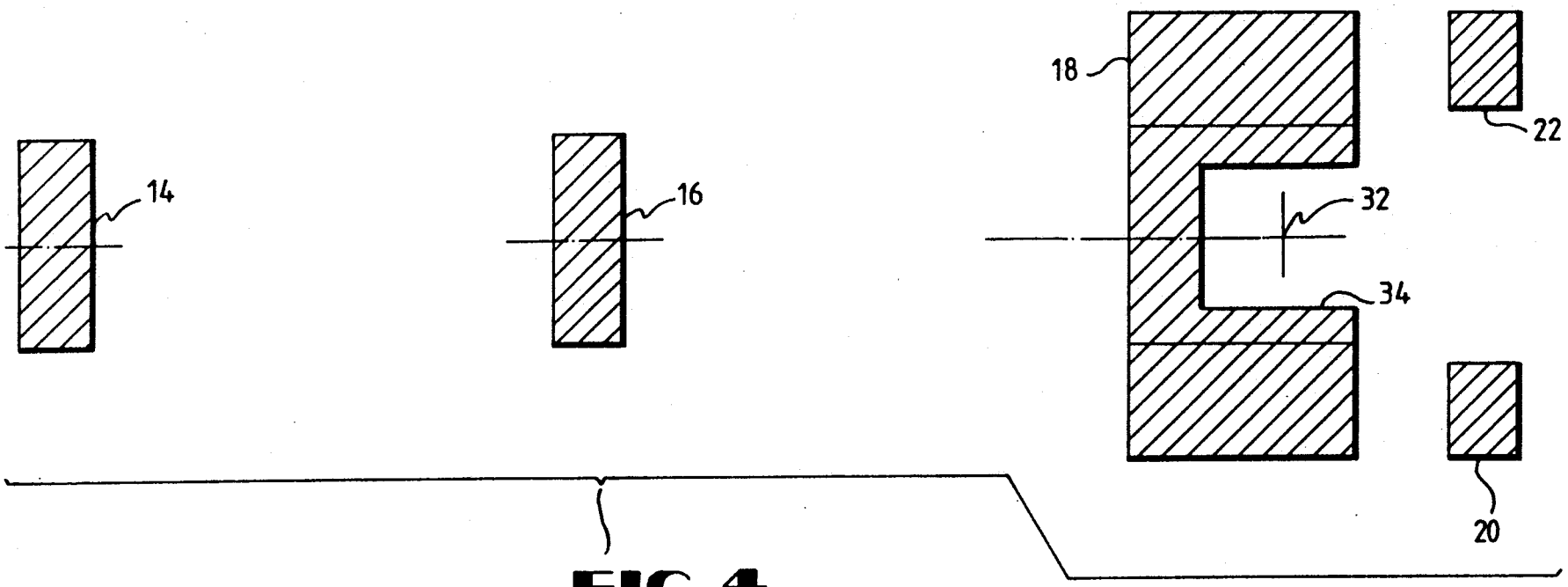
FIG. 4 illustrates the footprint of the portable drilling in its working mode.

FIG. 4 illustrates a preferred "footprint" of the module 10. For ease of illustration, the footprints are labeled using the element numbers of the respective feet. Essentially, the footprint describes the contact areas of the feet 14, 16, 18, 20 and 22 when the module 10 is in its working mode. The rear feet 18, 20 and 22 are located to enable the operator to back the module 10 over the well center 32 without destroying or damaging equipment extending above the well. Therefore, the feet 20 and 22 are positioned relatively far apart, preferably about 13' 9", so that they will not contact any equipment during positioning. Specifically, the feet 18, 20 and 22 are configured to avoid contacting the well house and the well head. Additionally, the foot 18 is dimensioned to maximize the stability of the module 10 when the module is in its working position. The foot 18 displays a notch 34. The configuration of the module 10 is such that, when properly positioned over the well, the well center 32 aligns with the center of the notch 34. Thus, the foot 18 not only facilitates positioning of the module 10 over the well center 32, but also surrounds the well center 32 on three sides to provide a stable platform for workover operations. Preferably, the footprints of the feet 14 and 16 are about 11' 4" wide and about 4' long; the footprints of the feet 20 and 22 are about 5' wide and 4' long; and the footprint of the foot 18 is about 23' 11" wide and about 12' long at its longest dimension. The notch 34 is preferably about 8' long and about 10' wide.

The module 10 also includes a telescoping derrick 36, one end of which is pivotally connected to a support structure 38 mounted near the rear of carrier 12. In its transportation mode, the derrick 36 is retracted and pivoted downwardly so that it rests in a telescoped, horizonal position atop the module 10. Preferably, the derrick 36 rests within a guide 40, which is located at an end of the module 10 opposite the support structure 38, to prevent unwanted movement of the derrick 36 during transportation.

To raise the derrick 36, two hydraulic cylinders 42 are energized. The hydraulic cylinders 42 are pivotally connected to the floor of the carrier 12 and to a lower portion 44 of the derrick 36. When the hydraulic cylinders 42 are energized, they extends and, thus, force the derrick 36 to pivot upwardly from a horizontal position to an upright and slightly backwards tilting position, as illustrated in FIG. 2. Once the hydraulic cylinders 42 have moved the derrick 36 to its upright position, two other hydraulic cylinders (not shown) are energized to telescopically extend an upper portion 46 of the derrick 36 to its full working height. As illustrated, a monkey board 45 is attached to the upper portion 46. Therefore, extension of the upper portion 46 also moves the monkey board 45 into its proper position to perform the workover operation.

Typically, the derrick 36 is not raised to its working position until the drilling module 10 has been properly positioned with respect to the well and the feet 14–22 have been lowered and locked. Preferably, the derrick 36 is of a type available from KREMCO of Edmonton, Alberta, Canada, having a static hook load capacity of 350,000 pounds and a racking capacity of 12,000' of 3½" drill pipe or 10,000' of 5½" tubing.

As illustrated, the drilling module 10 is mounted on a self-propelled carrier 12 so that it can easily move from worksite to worksite. Preferably, the carrier 12 is a model K1250 5-axle back-in type carrier available from KREMCO. The driver of the carrier 12 resides in an operating cab 48 at one end of the carrier 12, and the portion of the carrier 12 to the rear of the cab 48 carries equipment for use in workovers.

Figure 5:
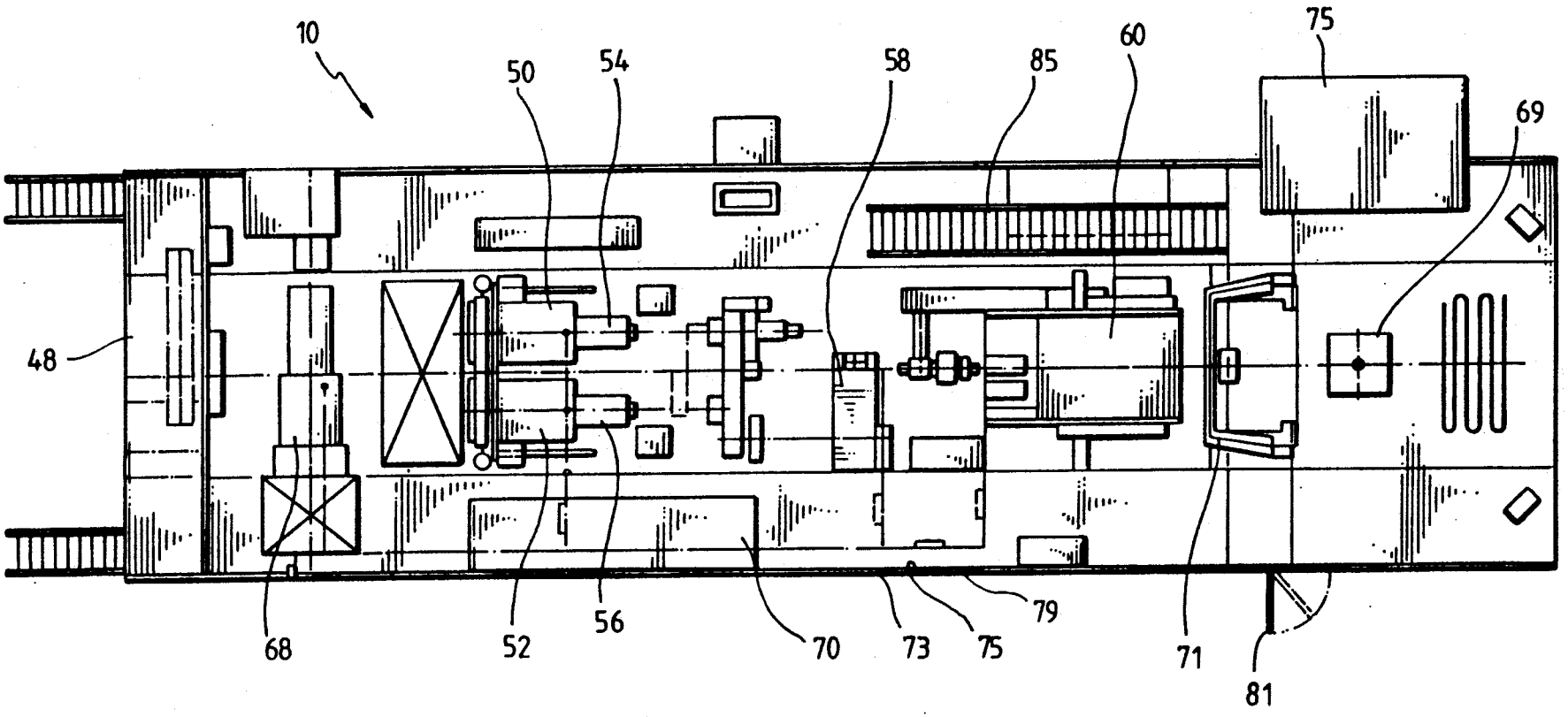
FIG. 5 illustrates a top interior view of the portable drilling module.
Figure 6:
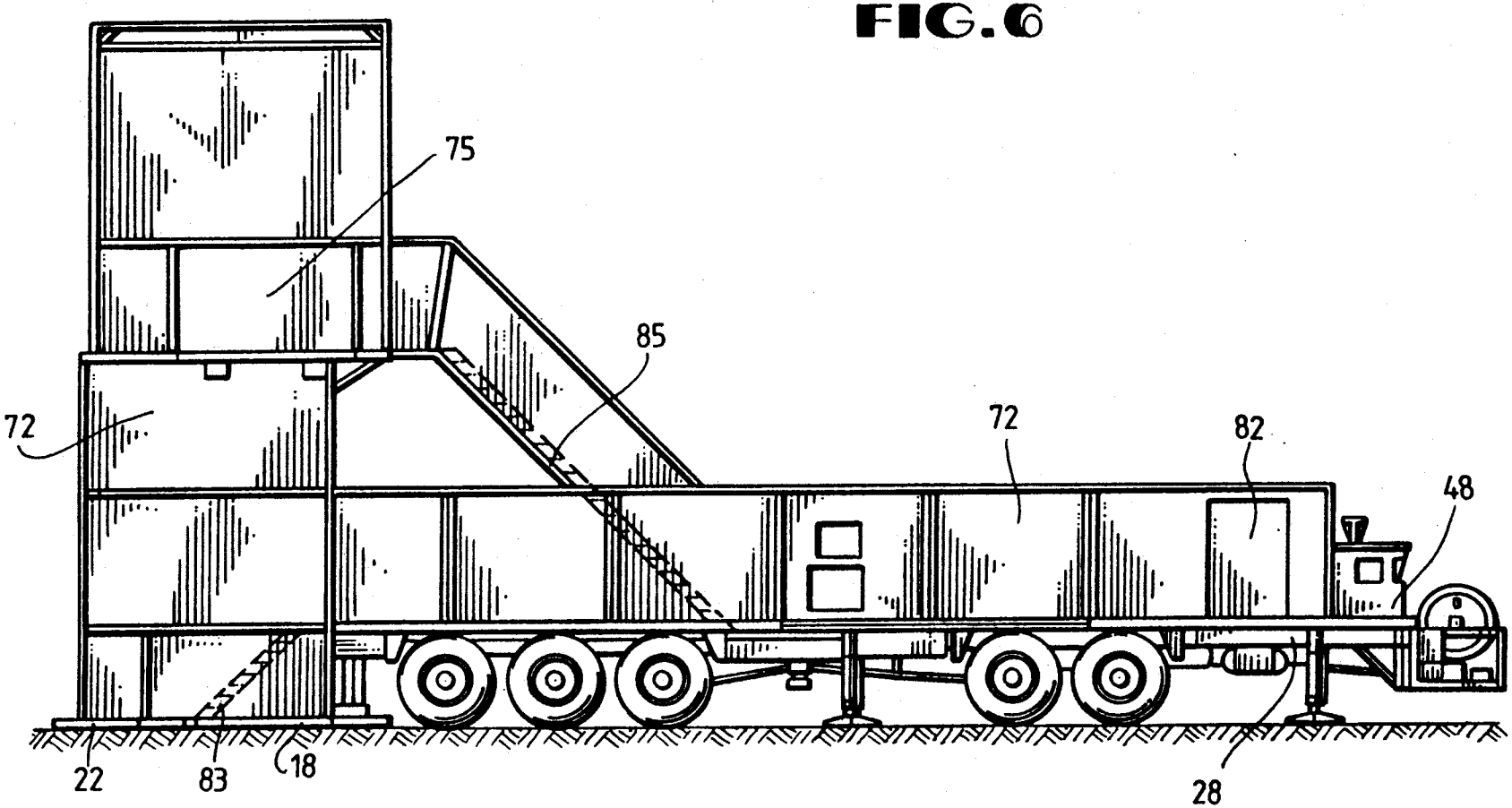
FIG. 6 illustrates an opposite side view of the lower portion of the portable drilling module illustrated in FIG. 3.

Referring additionally to FIG. 5, some of the contents of the module 10 are illustrated by a top view of the interior of the module 10. As illustrated, two engines 50 and 52 are mounted on the carrier 12. Each engine 50 and 52 is connected to a respective torque converter 54 and 56. Preferably, the engines 50 and 52 are model 3408 engines available from Caterpillar Inc. of Peoria, Ill. Preferably, the torque converters 54 and 56 are of a type available from Allison Corp. of Indianapolis, Ind. When it is desirable to transport the module 10 from one worksite to another, the engines 50 and 52 mechanically drive the axles 67 and 62 via drive shafts 64 and 66 which connect the axles to the torque converters 54 and 56 (see FIG. 1). Typically, only the front axles 67 steer the carrier 12.

The engines 50 and 52 also power a mud pump 58, a drawworks 60, and a rotary table 69. Preferably, the mud pump 58 is of a type available from USS Oilwell Suppliers Co. of Houston, Tex., and the drawworks 60 is of a type available from Midcontinent Supply Co. of Fort Worth, Tex. When the module 10 is in its working mode, the engines 50 and 52 provide power to the mud pump 58, to the drawworks 60, and to the rotary table 69 in a manner conventionally known in the art.

The module 10 may also house other equipment useful for workover operations. As illustrated the module 10 houses a generator set 68. While the generator set 68 is typically used to power only the lights and a few other electrical accessories, it is preferably sized so that it can provide all of the power to the drilling module 10 as well any other associated modules, such as a mud module and pipe shelter. Preferably, the generator set 68 includes a model 3408 engine coupled to a 365 kW a.c. generator. In addition, the module 10 advantageously houses an accumulator 70 for use with blow out preventors, and the module also includes a choke manifold and a rotary crankcase 71.

The module 10 not only houses the previously described equipment, but also protects the workmen from the harsh, cold environment in which the module 10 is preferably used. The sides and top of the module 10 are composed of winterizing panels 72. Preferably, the panels 72 have an outer skin 73 of 16 gauge steel, an inner skin 79 of 18 gauge steel, and about 3" of rigid fiberglass insulation 77 sandwiched therebetween. Advantageously, the panels 72 fully enclose all areas of the module 10 occupied by workmen during a routine workover operation. For example, some workmen usually work on the carrier floor 28 where most of the previously described equipment resides. Therefore, the panels 72 fully enclose the carrier floor 28.

The panels 72 also enclose a drill floor 74 that is located at the rear of the module 10. As illustrated, the drill floor 74 is higher than the carrier floor 28 and includes a "dog house" 75 which is generally used as an office. In the preferred embodiment, the drill floor 74 is about 24' above the ground when the module 10 is in its working mode. Preferably, the drill floor 74 is equipped with a power swivel, two hydraulic winches, and a 17½" rotary table. Preferably, the drill floor 74 is about 24' wide and about 19' long, and available from KREMCO.

The panels 72 extend above the drill floor 74 to allow the workmen on the drill floor to handle pipe sections for the pipe string. Advantageously, the module 10 may be used to workover wells of at least 8,000', and up to 12,000', deep using 30' pipe sections. It can be appreciated that up to 12,000' of 30' pipe sections could have to be removed from the well in order to change a drill bit, for instance. If these pipe sections were placed outside, then the workmen on the drill floor would be exposed to the environment, and if these pipe sections were sent back to the pipe shelter for temporary storage, then changing the drill bit would take an undesirably long time. To overcome these problems, the portion of the module 10 above the well is preferably made large enough to temporarily store an entire load of pipe. Since pipe section are usually withdrawn in double sections, the withdrawn pipe can be about 60' long. Therefore, the top of the module 10 over the drill floor 74 is preferably left uncovered to allow the pipe sections to be stood upright on the drill floor 74 for temporary storage.

However, it should be appreciated that the panels 72 completely surround the drill floor 74 to act as a wind. break. Therefore, portions of the panels 72 adjacent the derrick 36 are hinged to allow the derrick to be raised and lowered. In addition, a panel may be attached to the derrick 36 so that, when the derrick 36 is raised, the panel aligns with the panels on the drill floor 74.

As illustrated in FIGS. 1–3 and 6, the panels 72 also extend between the drill floor 74 and the ground to fully enclose the portion of the module 10 that is positioned over the well. The feet 18, 20 and 22, which are lowered in the working mode, are surrounded by panels 72 to form a structure not unlike an elevator. Thus, when the module 10 is configured in its working mode, the panels 72 form a box over the well (from the ground to about 45') to protect workmen near the well from the harsh environment.

Workmen may enter the module 10, when in its working mode, through a doorway 81 in the elevator portion of the module 10. Once inside the module 10, workmen can reach the carrier floor 28 by ascending a flight of stairs 83. Workmen can then reach the drill floor 74 by ascending a flight of stairs 85 which is also covered by panels 72.

Figure 7:
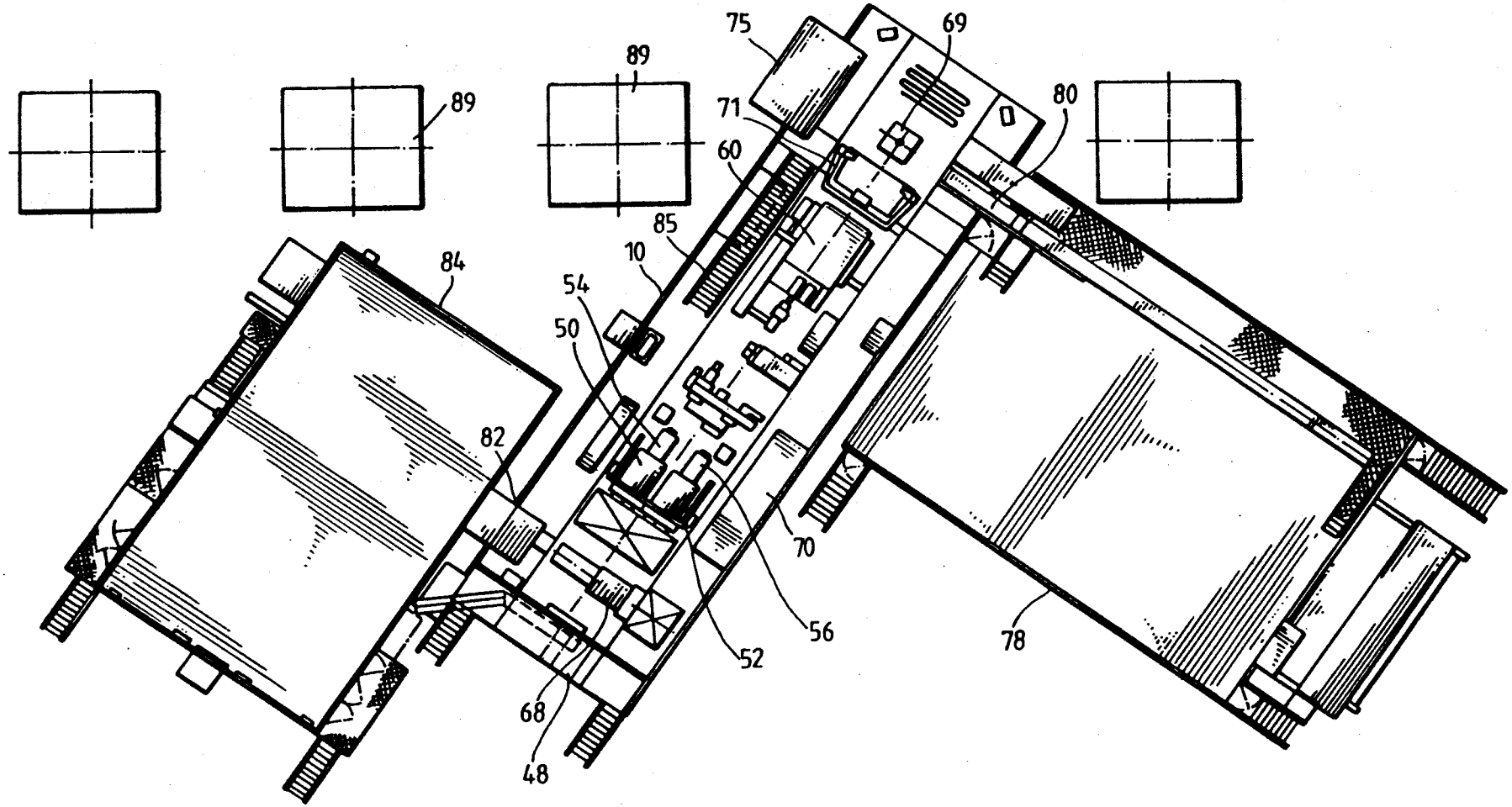
FIG. 7 illustrates a top interior view of the portable drilling module when connected to a portable mud module and a portable pipe shelter.

Just below the drill floor 74, an opening is provided in the panels 72 and referred to herein as a pipe transfer access 76. The pipe transfer access 76 couples to a pipe shelter 78, as illustrated in FIG. 7, so that pipe for the pipe string can be transferred between the drilling module 10 and the pipe shelter. Preferably, the pipe shelter 78 corresponds to the pipe shelter described in U.S. Pat. No. 5,072,656. In conjunction therewith, the drill floor 74 preferably includes an articulatable pipe ramp extension 80 for facilitating transfer of pipe between the module 10 and the pipe shelter. Preferably, the pipe ramp extension 80 corresponds to the pipe ramp extension described in U.S. Pat. No. 5,122,023.

The panels 74 provide a second opening in the module which is referred to herein as a passageway 82. The passageway 82 couples the module 10 to a mud module 84 so that workmen can move between the module 10 and the mud module 84 while remaining warm and sheltered. Preferably, the mud module ,84 corresponds to the mud module described in U.S. Pat. NO. 5,072,656. This application also describes a preferred orientation for the modules 10, 78 and 84 with respect to the wells 89.

In view of the above, it should be apparent that workmen can move freely from one module to the next without becoming exposed to the outside environment. Additionally, the module 10 is specifically constructed to provide workmen with an environment to fully accomplish most workover tasks in an efficient manner while they remain in the comfort of the shelter. Only if a workmen ascends to the monkey board 45 will he become exposed to the environment. Although the monkey board 45 is enclosed with panels 72, it is neither accessible through an environmentally sheltered path nor is it fully heated as are the modules 10 and 84 and the pipe shelter 78. Instead, only a small room (not shown) within the shelter on the monkey board 45 is heated using a small electric heater.

Since the module 10 is environmentally protected through the use of the panels 72, it is not surprising that the module 10 weighs much more than it would if it did not carry the panels 72. In fact, in a preferred embodiment, the module 10 weighs about 440,000 pounds, the panels 72 extend above the carrier floor 28 by at least 8' 7", and the module 10 is over 83' long and almost 24' wide. This much weight and size can damage roads when they thaw and become softer in the summer months in Alaska.

To overcome this problem, many of the panels 72 are removable. In the preferred embodiment, about 50% of the panels 72 extending along the sides of the carrier 12, and all of the panels 72 extending along a 12' width of the top of the module 10, can be removed. Preferably, the removable panels are bolted in place. Therefore, the panels can be easily removed by unbolting the panels 72 and lifting them off of the module 10 with a forklift or crane. The panels that remain on the module 10 are preferably welded in place. These non-removable panels advantageously provide structural rigidity to the module 10 and, thus, alleviate the need for heavy, permanent braces. To further enhance the structural integrity of the module 10, the panels 72 are preferably corrugated to increase their rigidity.

In view of the above description, it should be appreciated that the module 10 offers the advantage of providing continuous and complete shelter to workmen performing virtually every phase of a workover operation, and, yet, the module 10 may be partially stripped in warmer months so that it can be used all year.

We claim:

1. A drilling apparatus comprising:

a self-propelled carrier;

a derrick disposed on a first portion of said carrier, said derrick adapted to be moveable from a substantially horizontal transportation position to an upright working position over a well, and wherein said derrick is adapted to control insertion and retraction of at least 8000 feet of pipe sections into said well; and a shelter disposed on said carrier, said shelter adapted to permit the installation of said derrick upwardly through said shelter, and wherein said shelter extends from said well to a preselected height on said derrick and substantially surrounds a portion of said derrick and is adapted to temporarily store said pipe sections.

2. The apparatus, as set forth in claim 1, wherein said shelter comprises a hinged portion, said hinged portion being adapted to open to facilitate pivoting said derrick upright and to close so that said shelter substantially surrounds said upright derrick.

3. The apparatus, as set forth in claim 1, wherein a second portion of said carrier carries a drawworks and an engine adapted for coupling to said drawworks.

4. The apparatus, as set forth in claim 3, wherein said shelter substantially encloses a second portion of said carrier and facilitates movement of workmen between said second portion and said enclosed portion of said derrick without having to leave said shelter.

5. The apparatus, as set forth in claim 1, wherein said shelter is comprised of a plurality of winterizing panels.

6. The apparatus, as set forth in claim 1, wherein a portion of said panels are removable.

7. A drilling apparatus, comprising:

a self-propelled carrier;

a derrick disposed on a first portion of said carrier, said derrick adapted to be positioned over a well and to control insertion and retraction of at least 8000 feet of pipe sections into said well;

a shelter disposed on said carrier, said shelter extending from said well to a preselected height on said derrick, substantially surrounding a portion of said derrick, and being adapted to temporarily store said pipe sections; and a plurality of hydraulically operated feet disposed on said carrier, said feet being extended into contact with the ground when positioned in a working position and being retracted when positioned in a transportation position.

8. The apparatus, as set forth in claim 7, wherein said feet fully support said apparatus when positioned in said working position.

9. The apparatus, as set forth in claim 8, wherein a selected portion of said feet are located beneath said derrick and encompassed by said shelter in both said working and said transportation positions.

10. The apparatus, as set forth in claim 9, wherein one of said selected portion of said feet has a notch therein, said notch being adapted to partially surround said well when said feet are in said working position.

11. The apparatus, as set forth in claim 9, wherein said selected portion of said feet form a generally U-shaped footprint, said generally U-shaped footprint being configured so that said selected portion of said feet avoid contact with equipment protruding from said well during positioning of said derrick over said well.

12. The apparatus, as set forth in claim 11, wherein said selected portion of said feet comprise:

a U-shaped foot having a base portion and two outwardly extending portions and being adapted to partially surround said well when said U-shaped foot is in said working position; and two feet being displaced a preselected distance from said outwardly extending portions of said U-shaped foot, said two feet being spaced apart from one another.

13. A drilling apparatus comprising:

a wheeled carrier;

a drill floor coupled to said carrier;

a derrick disposed on said carrier and adapted to be positioned over a well adjacent said drill floor;

a shelter disposed on said carrier, said shelter substantially enclosing said carrier and said drill floor; and a plurality of hydraulically operated feet disposed on said carrier, said feet being extendable into contact with the ground for working and being retractable for transportation, a selected portion of said feet being located beneath said drill floor and being encompassed by said shelter in both said extended and retracted positions.

14. The apparatus, as set forth in claim 13, wherein said wheeled carrier is self-propelled.

15. The apparatus, as set forth in claim 13, wherein said derrick is adapted for pivotal motion between a transportation position, wherein said derrick rests horizontally along said carrier, and a working position, wherein said derrick stands vertically on said carrier.

16. The apparatus, as set forth in claim 13, wherein said shelter facilitates movement of workmen between said carrier and said drill floor without having to leave said shelter.

17. The apparatus as set forth in claim 16, wherein said feet fully support said apparatus when positioned in said extended position.

18. The apparatus, as set forth in claim 13, wherein one of said selected portion of said feet has a notch therein, said notch being adapted to partially surround said well when said feet are in said extended position.

19. The apparatus, as set forth in claim 13, wherein said selected portion of said feet form a generally U-shaped footprint, said generally U-shaped footprint being configured so that said selected portion of said feet avoid contact with equipment protruding from said well during positioning of said derrick over said well.

20. The apparatus, as set forth in claim 20, wherein said selected portion of said feet comprise:

a U-shaped foot having a base portion and two outwardly extending portions and being adapted to partially surround said well when said U-shaped foot is in said working position; and two feet being displaced a preselected distance from said outwardly extending portions of said U-shaped foot, said two feet being spaced apart from one another.

21. The apparatus, as set forth in claim 13, wherein said shelter is comprised of a plurality of winterizing panels.

22. The apparatus, as set forth in claim 21, wherein a portion of said panels are removable.

* * * * *